US007325359B2

(12) United States Patent
Vetter

(10) Patent No.: US 7,325,359 B2
(45) Date of Patent: Feb. 5, 2008

(54) PROJECTION WINDOW OPERATOR

(75) Inventor: Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 326 days.

(21) Appl. No.: 10/856,352

(22) Filed: May 28, 2004

(65) Prior Publication Data

US 2005/0262769 A1 Dec. 1, 2005

(51) Int. Cl.
*E05D 15/52* (2006.01)

(52) U.S. Cl. ..... 49/192; 49/324; 49/246

(58) Field of Classification Search ..... 49/324, 49/192, 193, 149, 246, 261; 16/315, 316
See application file for complete search history.

(56) References Cited

U.S. PATENT DOCUMENTS

| | | | | | |
|---|---|---|---|---|---|
| 163,113 | A | | 5/1875 | Starrett | |
| 203,123 | A | | 4/1878 | Deblois | |
| 441,943 | A | * | 12/1890 | De Kalb | 49/193 |
| 497,296 | A | | 5/1893 | Barber | |
| 531,244 | A | | 12/1894 | Abbott et al. | |
| 719,203 | A | | 1/1903 | Dreÿer | |
| 1,590,660 | A | * | 6/1926 | Williams | 296/96.2 |
| 2,374,618 | A | | 4/1945 | Perreton | |
| 2,863,182 | A | * | 12/1958 | Gabor | 49/261 |
| 3,447,265 | A | * | 6/1969 | Weber | 49/192 |
| 3,708,915 | A | * | 1/1973 | Davey | 49/340 |
| 4,449,325 | A | * | 5/1984 | Rawlings | 49/192 |
| 4,453,345 | A | * | 6/1984 | Maus | 49/193 |
| 4,541,200 | A | * | 9/1985 | Gartner | 49/192 |
| 4,866,882 | A | | 9/1989 | Cappello | |
| 5,535,551 | A | * | 7/1996 | Falk et al. | 49/324 |
| 6,070,637 | A | | 6/2000 | Jancan | |
| 6,581,331 | B1 | * | 6/2003 | Kral | 49/339 |
| 6,782,661 | B2 | * | 8/2004 | Manzella | 49/192 |
| 2004/0128914 | A1 | * | 7/2004 | Hempelmann | 49/192 |

* cited by examiner

*Primary Examiner*—Gregory J. Strimbu
(74) *Attorney, Agent, or Firm*—Patterson, Thuente, Skaar & Christensen, PA

(57) ABSTRACT

A projection window operator providing horizontal displacement of a window relative to a vertical plane of the frame of the window. With at least one projection window operator installed on each of opposing sides of the window, the window can be actuated between a first closed position and second open position in which a trickle ventilation is provided around the window. The projection window operators installed on the window can be interconnected for simultaneous actuation, or actuated individually, providing selective ventilation on either side.

8 Claims, 9 Drawing Sheets

PROJECTION WINDOW OPERATOR

FIELD OF THE INVENTION

The present invention relates generally to operators, and more particularly, to projection window operators.

BACKGROUND OF THE INVENTION

Casement, double-hung, sliding, and other windows are common and generally known. These windows and their associated operators provide ventilation and interior/exterior access by generally displacing a window sash relative to a surrounding frame structure through slidable or pivotal movement. In some applications, however, such displacement is undesirable. For example, displacement of a sash relative to a surrounding frame can be esthetically displeasing from the exterior, particularly on large buildings with many windows. A casement window, in which the window typically pivots outward relative to the frame, can be impractical or dangerous in areas of high wind.

Projection, or stand-out, windows are also known and can be used where it is desired to minimize the visual impact of open windows relative to the rest of a structure, or where it is impractical or infeasible to use the windows described above. A projection window generally provides a horizontal displacement of the sash relative to the surrounding frame, thereby providing a trickle ventilation around the entire window.

For example, U.S. Pat. Nos. 497,296 and 531,244 disclose early projection-type windows. These windows were suited for ventilating railway passenger cars, among other applications.

U.S. Pat. No. 2,374,618 discloses a sash movably supported on a window frame at each of opposite vertical sides thereof by a link arrangement comprising a long bar and short bars, the two latter respectively lying at opposite sides of the long bar. The construction described and depicted permits the sash adjustably to be moved bodily away from the window frame and into various positions.

A stand-out window opening mechanism is described in U.S. Pat. No. 4,866,882. The window opening mechanism moves the entire window sash outwardly from the window frame in a plane parallel to the plane of the frame. The mechanism for accomplishing this includes a pair of pivoted L-shaped lever arms on each side of the window. The short legs of these lever arms are substantially shorter than the long legs, and the ends of the short legs are pivotally attached to the window frame relatively close together. An operating mechanism is provided for moving the elbows of the lever arms toward and away from one another, and the ends of the long legs of the arms are pivotally connected at spaced apart points on the window sash. As the elbows of the levers on both sides are moved toward one another, the window sash is pulled toward the frame. When the elbows are moved away from one another, the pivoting action of the lever arms causes the window sash to be moved outwardly from the frame to provide a "stand-out" opening of the window.

U.S. Pat. No. 6,070,637 discloses a horizontally openable window. The window comprises a screen-like enclosure between the window casement and the window frame that limits the amount of moisture or dust that can enter through the window when in an open position.

Projection windows such as those identified above that are presently known include complex mechanisms for operating the window and supporting the sash in both extended and retracted positions. These mechanisms can limit the applications of projection windows because they occupy more space and require a deeper window frame. Further, in some applications it may still be desired to operate a projection window like a casement window, opening and closing only one vertical side of the window on a pivot relative to the frame, or to similarly pivotally open and close only one horizontal side.

For the foregoing reasons, there is a need for a projection window operator that is compact and secure. There is also a need for a projection window operator that provides for selectable opening and closing of the window in various other configurations.

SUMMARY OF INVENTION

The present invention is directed to a window operator that is particularly suitable for use with projection-type windows. In one embodiment, the projection window operator includes a base, a cam, a stud, an arm, a cover, a roller, a rivet, and a roller rivet, in operable communication to horizontally project a window sash relative to a vertical plane of a window when assembled. The operator is mounted to a window frame via the base and to a window sash via a sash bracket. In operation, the operator is actuated by the cam between a first position in which the window is closed and a second position in which the window is open. In the first position, the cam is raised relative to the base and cover and the arm is retracted, holding the window closed. In the second position, the cam is lowered relative to the base and cover and the arm is extended, holding the window in an open position where the sash is horizontally projected relative to the vertical plane of the frame.

In one embodiment, at least two operators are installed on a window. For stability and support, at least one operator is installed on each of opposing vertical sides of the window. In a further embodiment, at least one operator is installed on each of opposing horizontal sides of the window. In a yet further embodiment, four operators are installed on a window, with two operators installed on each of opposing vertical sides of the window. The two operators on each side can be connected for simultaneous actuation. In one embodiment, all of the operators installed on a window are connected for simultaneous actuation.

In a further embodiment, selective ventilation is enabled by the operator. A configuration having two operators installed on opposing vertical sides of a window provides selective and independent actuation and projection of each vertical side. The operators located on a first vertical side of the window can be actuated simultaneously to open only that side of the window while the second vertical side is left closed or subsequently opened in the same manner as the first vertical side.

The above summary is not intended to describe each illustrated embodiment or every implementation of the invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
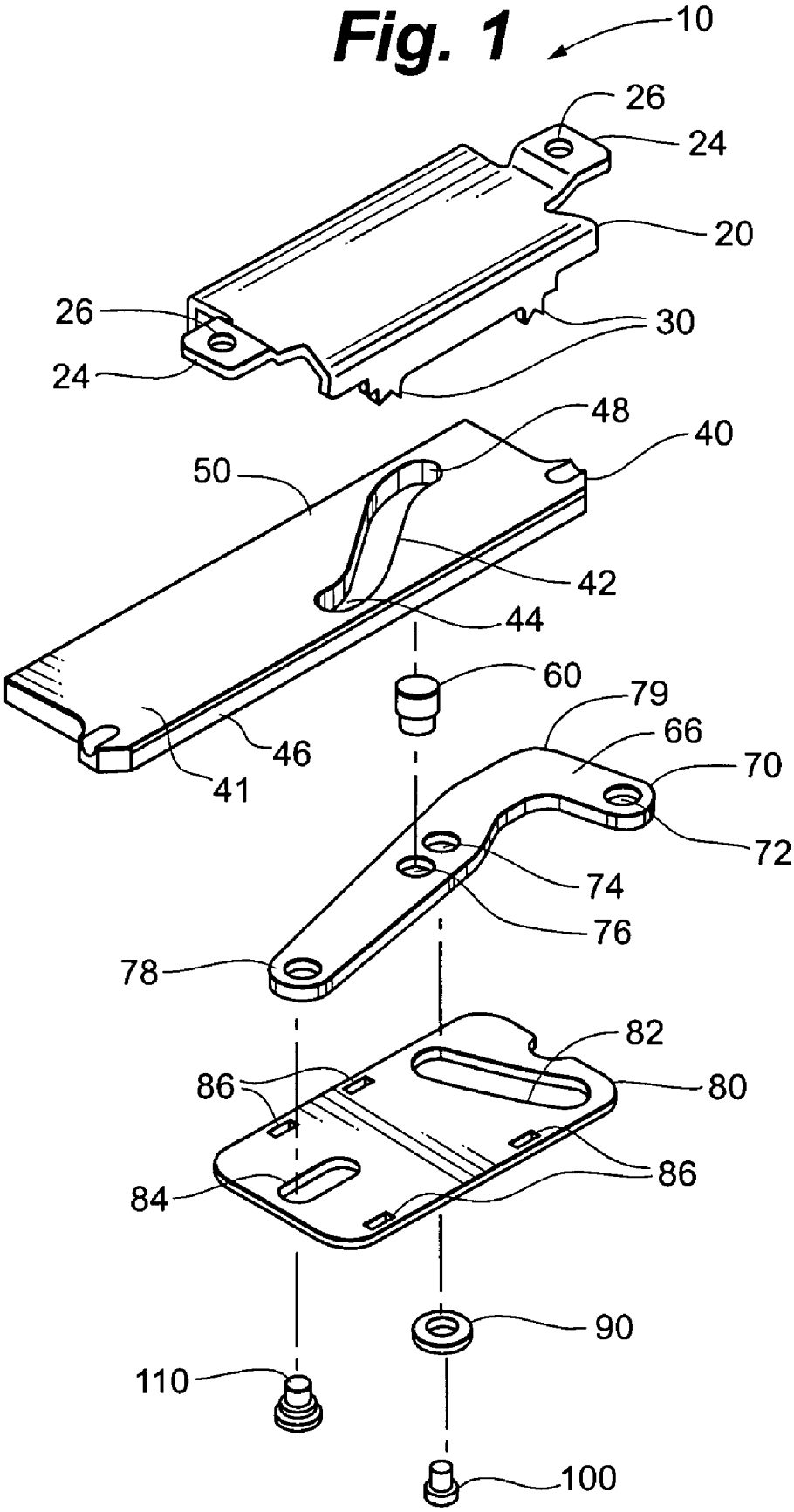
FIG. 1 is an exploded assembly view of a portion of a projection window operator in accordance with the present invention.

While the invention is amenable to various modifications and alternative forms, specifics thereof have been shown by way of example in the drawings and will be described in more detail herein. It should be understood, however, that the intention is not to limit the invention to the particular embodiments described, but the should be understood to encompass all modifications, equivalents, and alternatives falling within the spirit and scope of the invention as defined by the appended claims.

DETAILED DESCRIPTION OF THE INVENTION

The projection window operator of the invention as disclosed herein provides a hardware system operable to horizontally project a window relative to the vertical plane of a surrounding frame. The operator is also adaptable for use with various window and ventilation configurations, for example a horizontally positioned window, vent, or skylight. The invention can be more readily understood by reference to FIGS. 1-15B and the following description. While the invention is not necessarily limited to such an application, the invention will be better appreciated using a discussion of representative embodiments as shown and described herein.

Figure 2:
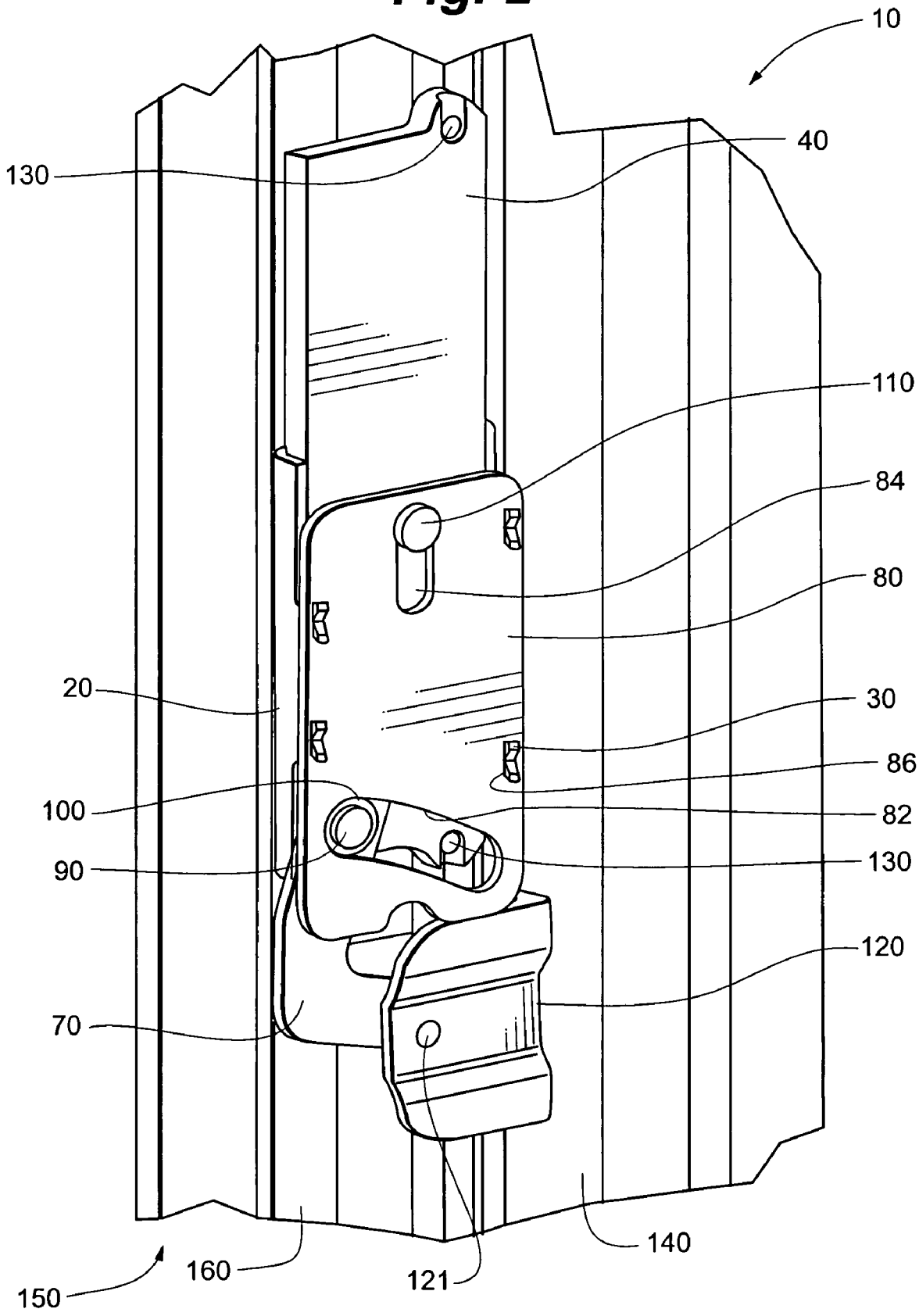
FIG. 2 is a perspective view of an embodiment of a projection window operator according to the invention depicting the operator and window in a closed position.
Figure 3:
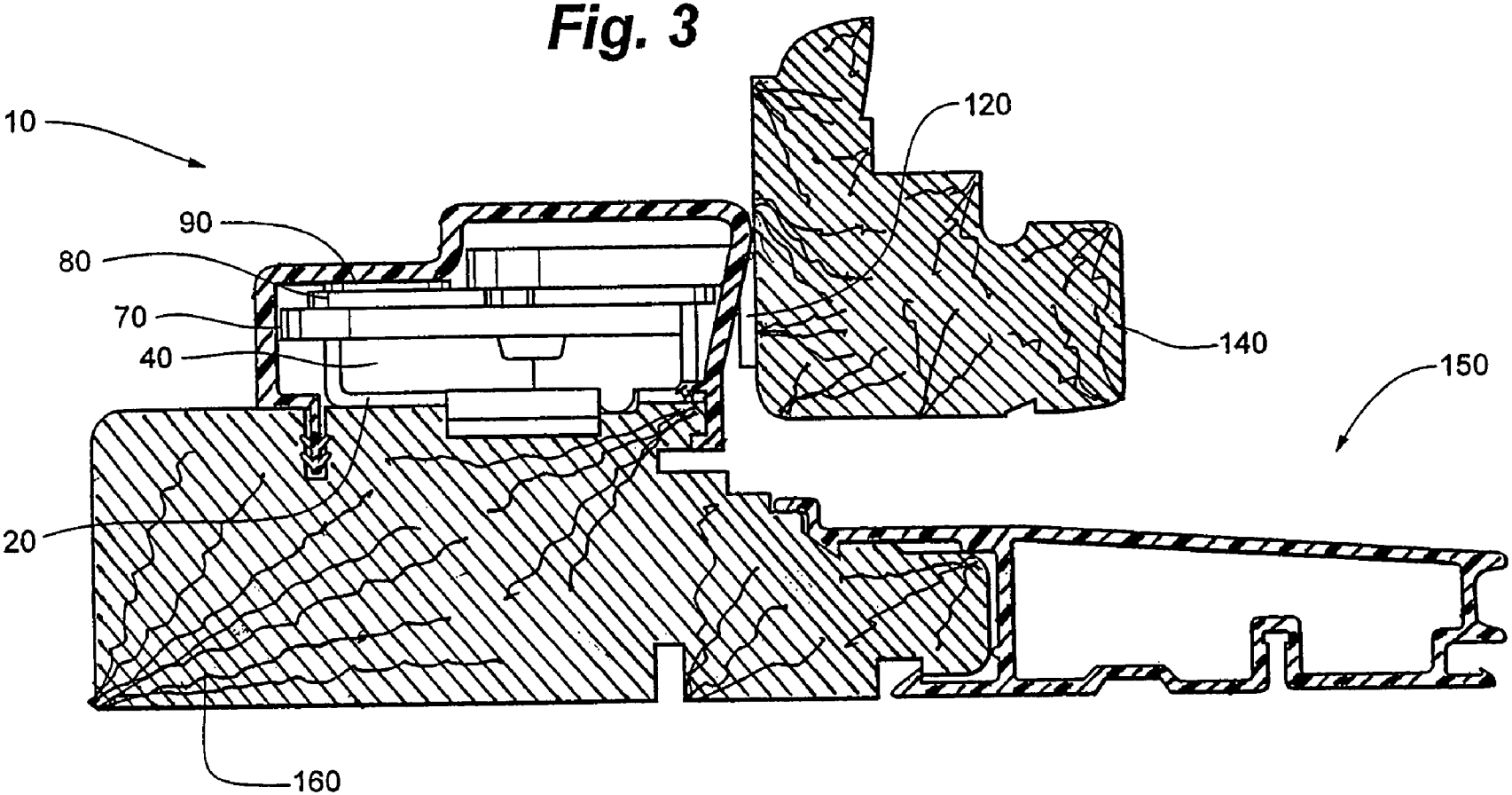
FIG. 3 is a cross-sectional end view of the projection window operator of FIG. 2 depicting the operator and window in a closed position.
Figure 4:
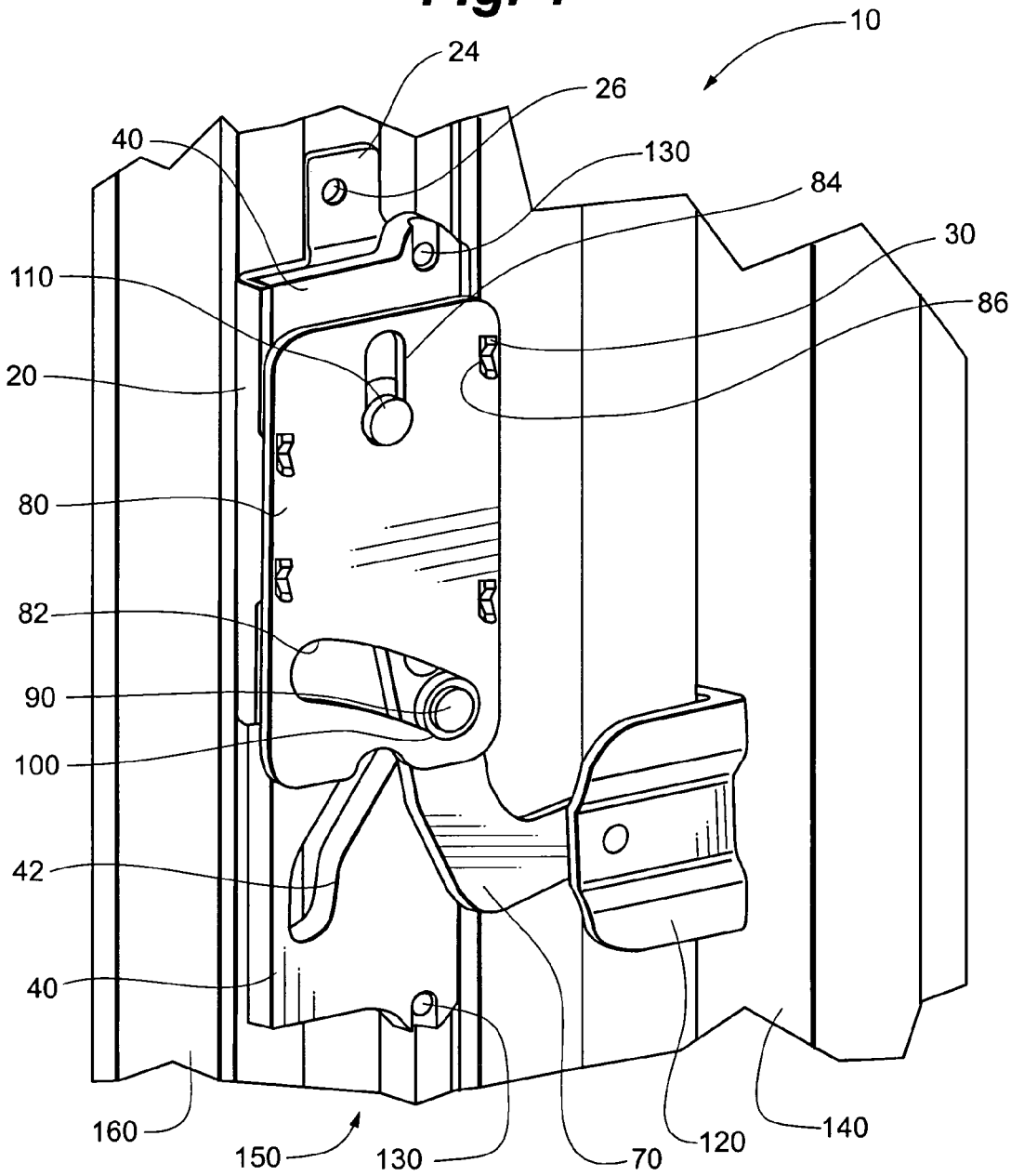
FIG. 4 is a perspective view of the projection window operator of FIG. 2 depicting the operator and window in an open position.
Figure 5:
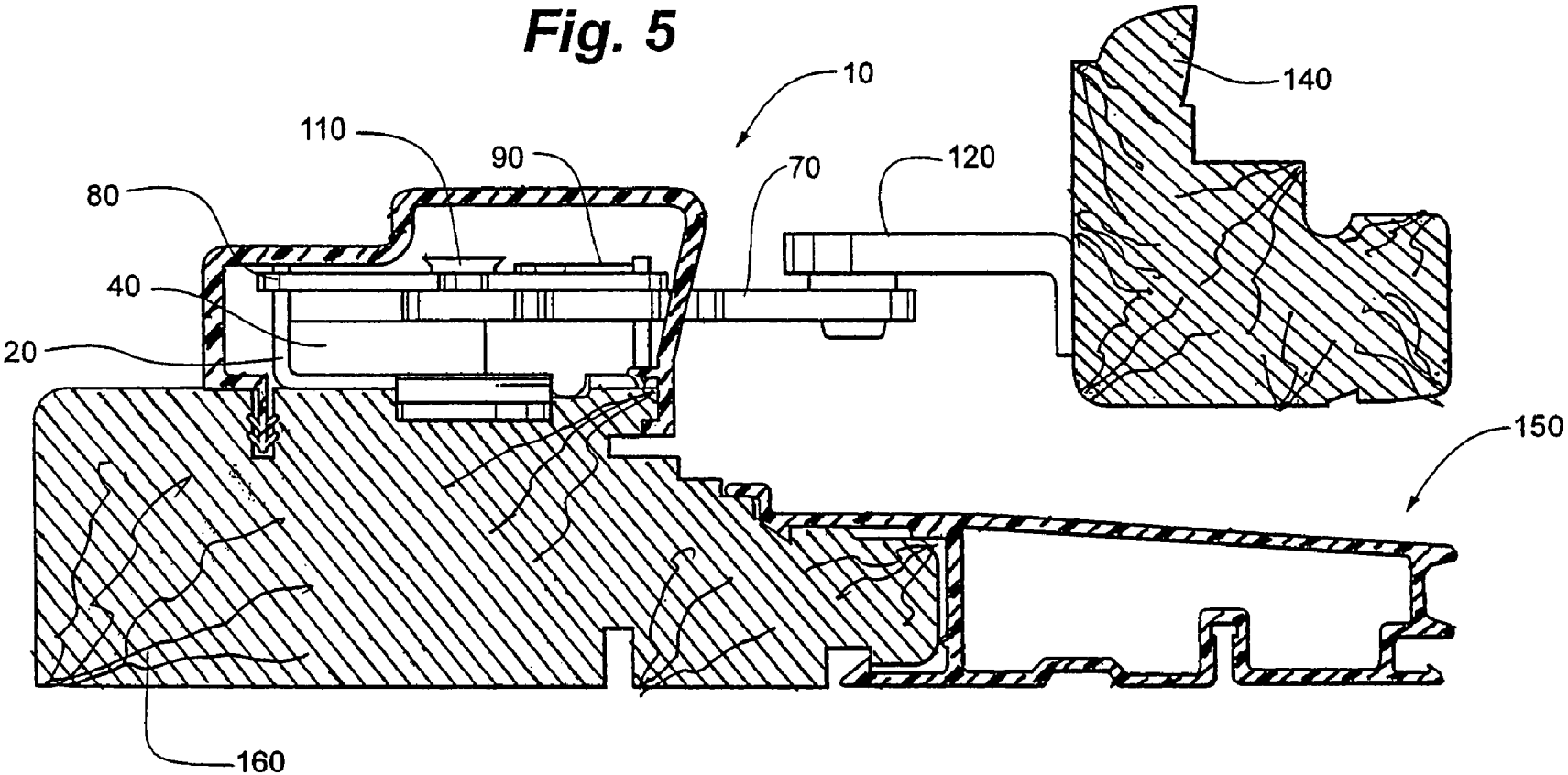
FIG. 5 is a cross-sectional end view of the projection window operator of FIG. 2 depicting the operator and window in an open position.
Figure 14:
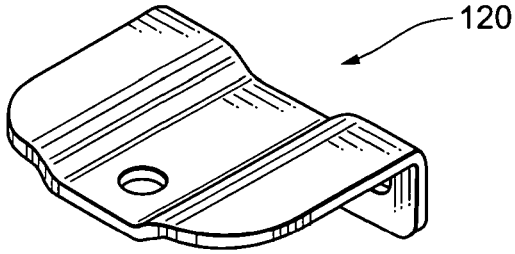
FIG. 14 is a perspective view of the sash bracket of an embodiment of a projection window operator according to the present invention.
Figure 15A:
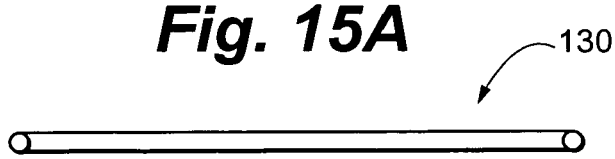
FIG. 15A is a top view of a tie bar of an embodiment of a projection window operator according to the present invention.
Figure 15B:
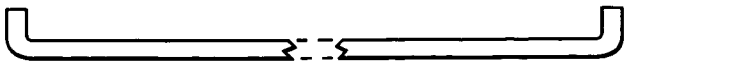
FIG. 15B is a side view of the tie bar of FIG. 15A.

Referring to FIG. 1, a projection window operator 10 in accordance with one embodiment of the present invention generally includes base 20, cam 40, cam follower 60, arm 70, cover 80, roller 90, roller rivet 100, and rivet 110 in operable communication to horizontally project a window sash 140 relative to a vertical plane of the window 150 when assembled. Operator 10 is mounted to a window frame 160 or other surrounding structure via base 20 and to the window sash 140 via a window sash interface in the form of sash bracket 120 (FIG. 14). As depicted in FIGS. 2-5, operator 10 is actuated by cam 40 between a first position in which the window 150 is closed, as shown in FIGS. 2 and 3, and a second position in which the window 150 is open, as shown in FIGS. 4 and 5. In the first position, cam 40 is raised relative to base 20 and cover 80 and arm 70 is retracted, holding the window closed as depicted in FIG. 2. In the second position, cam 40 is lowered relative to base 20 and cover 80 and arm 70 is extended, holding the window in an open position where the sash is horizontally projected relative to the vertical plane of the frame.

The various components of operator 10 will now be described in more detail. The components described herein may be made from any and all suitable materials, such as plastics, metals, alloys, or any combination thereof, and scaled as appropriate for a desired application, so long as the functioning aspects of the operator and its components are not compromised.

Figure 6:
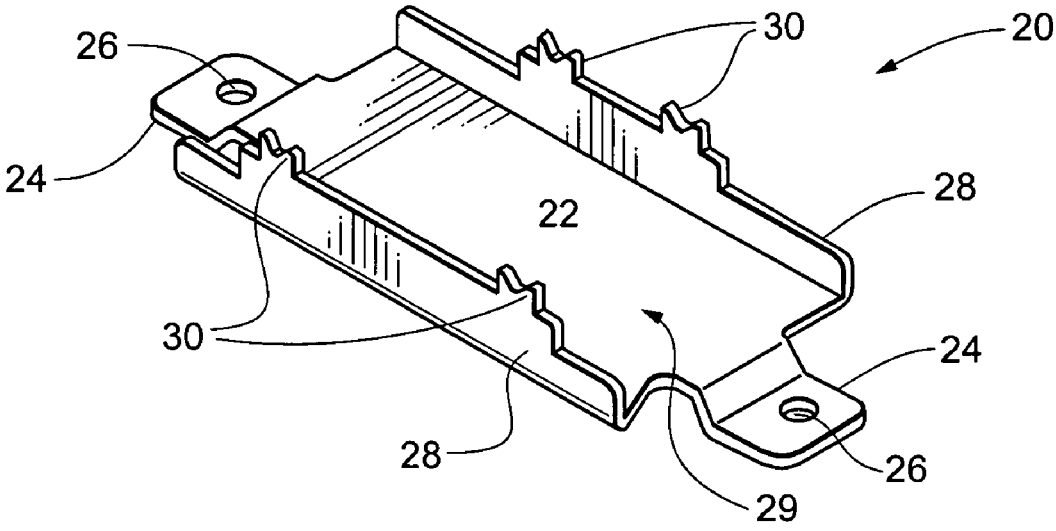
FIG. 6 is a perspective view of the base of the projection window operator depicted in FIG. 1.

Referring to FIG. 6, base 20 generally includes main portion 22, fastener holes 26, and raised side portions 28 defining channel 29. Fastener holes 26 are formed to receive fasteners, such as screws (not shown), to secure operator 10 to a window frame. As depicted in the embodiment of FIG. 6, a single fastener hole 26 is located on each of two tab portions 24 positioned on opposing longitudinal ends of main portion 22 of base 20, although in other embodiments the fastener holes 26 can be located on main portion 22 of base 20 or on tabs 24 located elsewhere on main portion 22 of base 20. Raised side portions 28 of base 20 are formed so as to interlock with cover 80 (FIG. 10) and define channel 29. In one embodiment, side portions 28 include a plurality of teeth 30 positioned so as to be received by and interlock with apertures on cover 80. Other means, for example tabs or pegs, can be used in place of teeth 30 to interlock with corresponding apertures on cover 80. When operator 10 is assembled, base 20 and cover 80 interlock to substantially enclose cam 40, arm 70, and other components, with the longitudinal ends substantially open to permit actuation of cam 40 between the first position and the second position and corresponding pivotal movement of arm 70.

Figure 7:
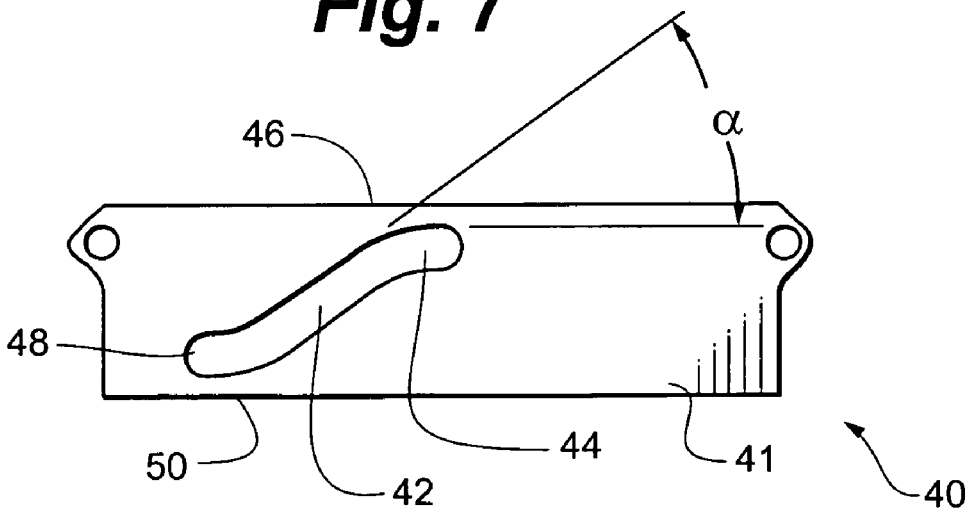
FIG. 7 is a plan view of the cam of the projection window operator depicted in FIG. 1.
Figure 8A:
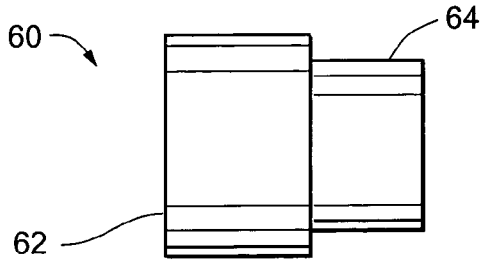
FIG. 8A is a side view of the cam follower of the projection window operator depicted in FIG. 1.
Figure 8B:
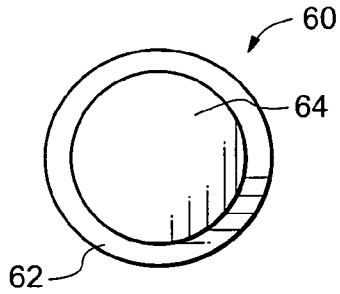
FIG. 8B is an end view of the cam follower of the projection window operator depicted in FIG. 1.

FIG. 7 depicts cam 40 and FIGS. 8A and 8B depict cam follower 60. Cam 40 is slidably disposed in channel 29 of base 20 and generally includes body portion 41 with a generally s-shaped cam slot 42 defined therein to receive and guide first portion 62 of cam follower 60. Second portion 64 of cam follower 60 is fixed to arm 70 as further described hereinbelow. Cam slot 42 is generally angled with respect to a longitudinal axis of cam 40, extending from a first slot end 48 proximate first edge 50 and corner of cam 40 to a second slot end 44 near the longitudinal center and proximate a second opposing edge 46 of cam 40. The first and second slot ends 48 and 44 are formed at an angle $\alpha$ to the central portion of cam slot 42, and generally parallel with the longitudinal axis of cam 40 such that the slot ends 44 and 48 hold cam follower 60 at the first slot end 48 when cam 40 is in the first position relative to base 20 (FIG. 2) and the window is closed, and at the second slot end 44 when the cam is in the second position relative the base 20 (FIG. 4) and the window is open. In one embodiment, angle α is 35 degrees.

Figure 9:
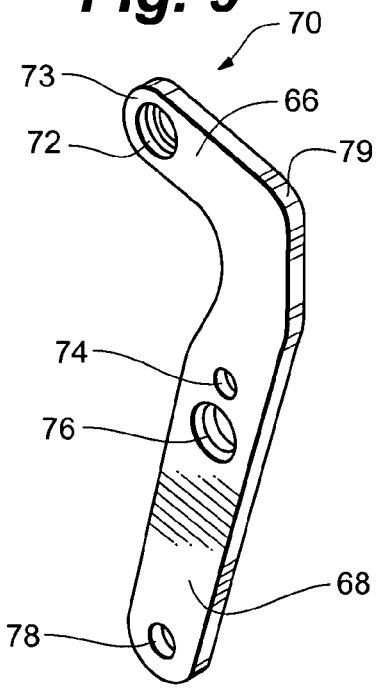
FIG. 9 is a perspective view of the arm of the projection window operator depicted in FIG. 1.

Arm 70 is depicted in FIG. 9. Arm 70 generally includes first portion 66 and second portion 68 positioned at an angle with each other forming an elbow 79. Arm 70 further has a plurality of apertures 72, 74, 76, 78 defined therein. First aperture 72 is defined proximate the distal end 73 of first portion 66 of arm 70, and receives fastener 121 to rotatably couple arm 70 to sash bracket 120 (FIG. 14). Although an angled configuration for arm 70 is depicted, any other configuration and connection of arm 70 with cam 40 and window sash interface 120, including a straight arm 70, that enables a projecting motion of window sash 140 from window frame 160 is also contemplated as being within the scope of the present invention.

Figure 11A:
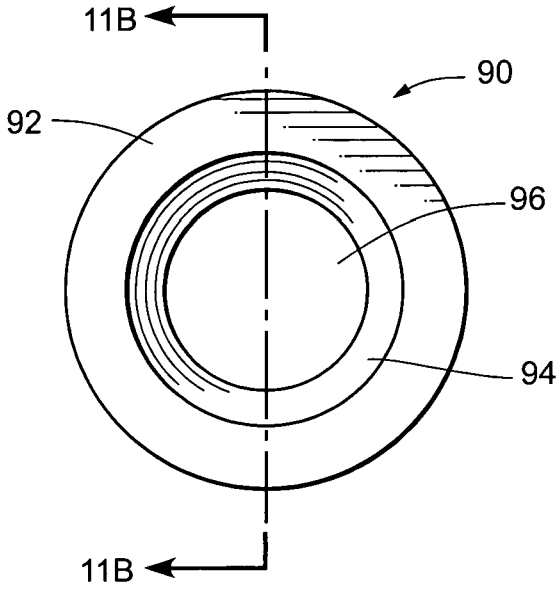
FIG. 11A is a top view of the roller of the projection window operator depicted in FIG. 1.
Figure 11B:
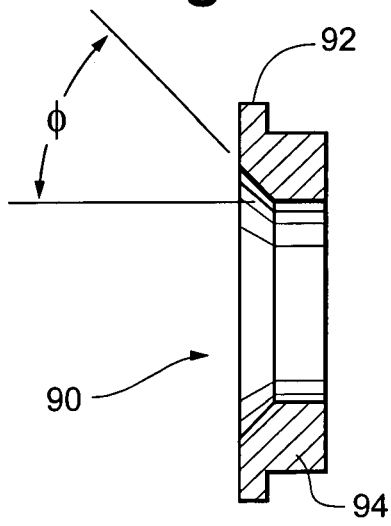
FIG. 11B is a side sectional view of the roller depicted in FIG. 11A taken at section 11B-11B.
Figure 12A:
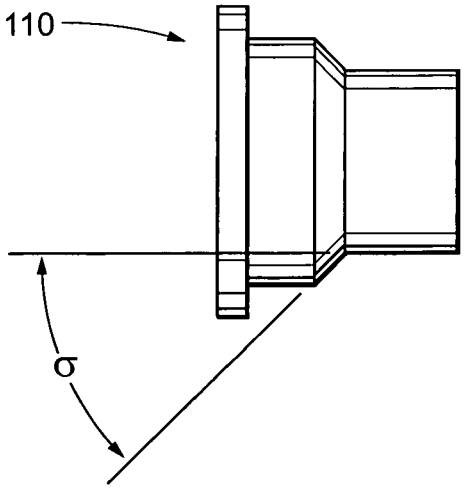
FIG. 12A is a side view of the rivet of the projection window operator depicted in FIG. 1.
Figure 12B:
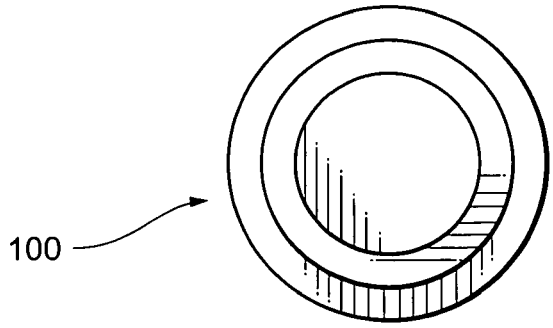
FIG. 12B is a top view of the rivet of the projection window operator depicted in FIG. 1.
Figure 13A:
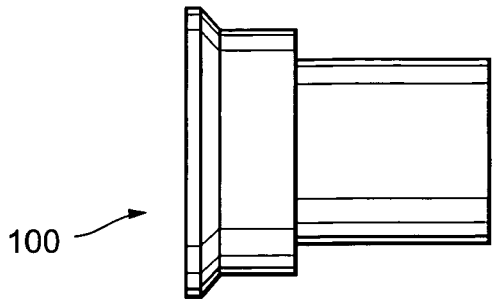
FIG. 13A is a side view of the roller rivet of the projection window operator depicted in FIG. 1.
Figure 13B:
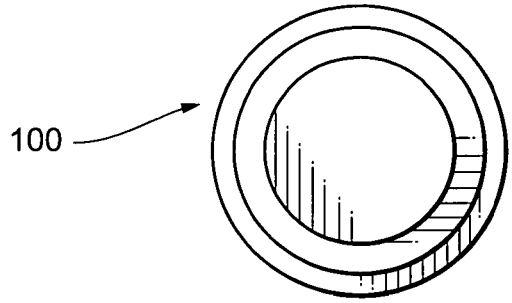
FIG. 13B is a top view of the roller rivet of the projection window operator depicted in FIG. 1.

Second aperture 74, defined substantially in the middle of second portion 68 of arm 70 and proximate third aperture 76, receives roller rivet 100 to rotatably and slidably couple arm 70 with cover 80 via roller 90. Roller 90 is depicted in FIGS. 11A and 11B and roller rivet 100 in FIGS. 12A and 12B. Roller 90 generally includes lip portion 92 and base portion 94, wherein the radius of lip portion 92 is larger than that of base portion 94 to retain roller 90 in second aperture 82. Roller rivet 100 extends through central aperture 96 in roller 90 to third aperture 76 of arm 70, where chamfer angle Φ of central aperture 96 through lip portion 92 of roller 90 corresponds to an angle a of roller rivet 100. In one embodiment, angles Φ and a are 45 degrees. As alternatives to roller 90 and roller rivet 100, a wide variety of other arrangements for coupling arm 70 with cover 90 are contemplated within the scope of the invention. For example, roller 90 and roller rivet 100 may be replaced by a fastener without a roller fixed within second aperture 74 of arm 70 or with an integral projection of arm 70, either of these being slidably received in slot 82 of cover 80.

Second portion 64 of cam follower 60 is fixed within third aperture 76 of arm 70 so that cam follower 60 projects outwardly from arm 70. It will be appreciated that as an alternative, cam follower 60 may be an integral projection of arm 70.

Rivet 110 is received in fourth aperture 78 to couple arm 70 to cover 80. It will be appreciated that arm 70 could be coupled to cover 80 via any other suitable structure slidable in slot 84 of cover 80, such as for example an integral projection formed on arm 70.

When cam 40 is actuated between the first position and second position, arm 70 is actuated between a first retracted position (FIG. 2) and a second extended position (FIG. 4), extending and retracting sash bracket 120 (FIG. 14) coupled to the window sash and thereby opening and closing the window.

Figure 10:
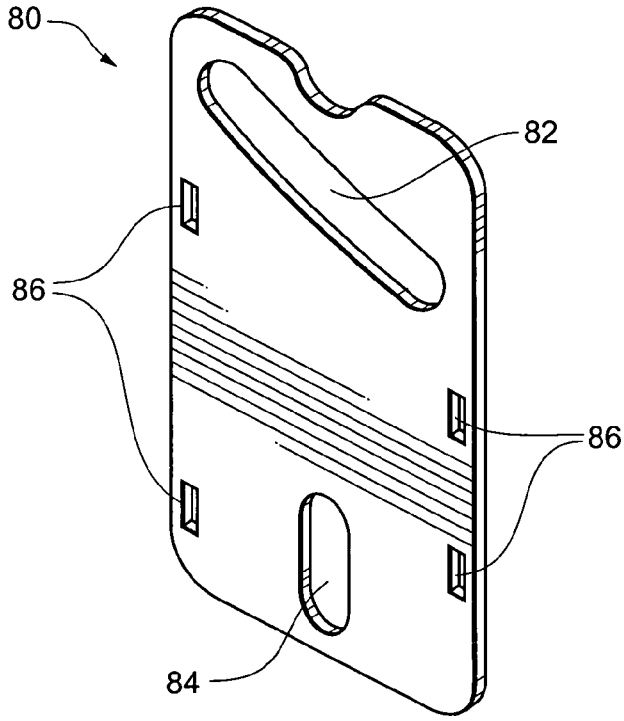
FIG. 10 is a perspective view of the cover of the projection window operator depicted in FIG. 1.

Cover 80 is depicted in FIG. 10 and includes arm guide structures in the form of non-parallel slots 82 and 84. Slot 82 is defined proximate a first longitudinal end of cover 80 and at a slight angle so as to receive roller 90. Slot 84 is defined proximate to and extending perpendicularly from the opposing longitudinal end of cover 80. Slot 84 receives rivet 110 to define the motion of arm 70 when cam 40 is actuated between the first position and the second position. Slots 82 and 84 are configured such that actuating cam 40 extends arm 70 to displace sash bracket 120, depicted in FIG. 14, generally perpendicularly relative to the plane of the window. Cover 80 further includes apertures 86 configured to interlock with teeth 30, or other interlocking means, and couple cover 80 to base 20 as described above. Although depicted as a separate component in the depicted embodiments, in other embodiments of the invention (not depicted), cover 80 may be integrally formed with base 20. Moreover, in other alternative embodiments (not depicted) cover 80 may be entirely omitted. In these embodiments, arm 70 may directly coupled to base 20 at a single attachment point, and cam 40 actuates arm 70 as cam 40 is moved as before.

When the window is closed, first portion 62 of cam follower 60 is positioned in first slot end 48 of cam slot 42 to hold arm 70 in a retracted position, locking the window in a closed position. As cam 40 slides between the first position and second position to open or close the window, cam follower 60 slides within cam slot 42 as rivet 110 slides within cover slot 84 and roller 90 and roller rivet 100 interact with cover slot 82 to extend or retract arm 70 and sash bracket 120 and horizontally to displace the window sash relative to the vertical plane of the window frame. Moving the window sash perpendicularly with no parallel motion component relative to the plane of the window frame minimizes the effort required to open and close the window because the window is neither raised nor lowered. When the window is open, cam follower 60 is positioned in second slot end 44 of cam slot 42 to hold arm 70 in an extended position, locking the window in the open position. Cam 40 is also operably coupled to tie bars 130, shown in FIGS. 15A and 15B, via apertures 44 or other means, where tie bars 130 are operable to actuate cam 40 between the first and second positions.

To provide stability, at least three operators 10 will generally be installed on a window, with each located on a different side of the window for adequate support. Alternatively, two operators 10 could be located on a first side of the window and a third operator 10 could be located on a second, opposite side. Preferably, four operators 10 will be installed on a window, with two operators 10 located on opposing vertical sides of the window, or on opposing horizontal sides of the window.

In an installation having two operators 10 installed on each vertical side of the window, tie bars 130 can operably interconnect the first operator 10 to the second operator 10 located on the same vertical side of a window such that the two operators 10 are actuated in unison. In one embodiment, all of the operators 10 on a window are connected so as to be actuated and to operate in unison.

Selective ventilation can also be enabled by the invention. A configuration having two operators 10 mounted on opposing vertical sides of a window further provides selective and independent actuation and projection of each vertical side. The operators 10 located on a first vertical side of the window can be actuated simultaneously to open only that side of the window while the second vertical side is left closed or subsequently opened in the same manner as the first vertical side. Operation in this manner is possible with limited compliance between the sash brackets 120 and the arms 70 on each operator 10, as the plane of the window does not remain perpendicular to the planes of the arms 70. Similarly, operators 10 can be mounted on opposing horizontal sides of a window to provide selective ventilation along either the top or bottom edge.

Although the present invention has been described in considerable detail, it will be appreciated that additional advantages and modifications will be readily apparent to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A projection window operator comprising:

a base adapted to be fixedly coupled to a window frame, the base defining a channel therein;

a window sash interface portion adapted to be fixedly coupled to a window sash movably attached to the window frame;

a cam engaged with the channel of the base, the cam selectively slidably positionable in the channel between a first position and a second position relative to the base; and an arm operably coupling the cam to the window sash interface portion, the window sash interface portion being positioned by the arm in a first retracted position proximate the channel when the cam is positioned in the first position and the window sash interface portion being positioned by the arm in a second extended position spaced-apart from the channel when the cam is positioned in the second position, so that when the base is coupled to the window frame and the window sash interface portion is coupled to the window sash, movement of the cam from the first to the second position projects the window sash outward from the window frame, wherein the cam includes a body portion with a generally s-shaped cam slot defined in the body portion, the cam slot having a pair of opposing ends, wherein the arm includes a cam follower portion, and wherein the cam follower portion is slidably disposed in the s-shaped cam slot of the cam.

2. The operator of claim 1, wherein the window sash interface portion is locked in the first retracted position when the cam follower is positioned at one of the pair of opposing ends of the cam slot, and wherein the window sash interface portion is locked in the second extended position when the cam follower is positioned at the opposite one of the pair of opposing ends.

3. The operator of claim 1, further comprising a cover engaged with the base.

4. The operator of claim 3, wherein the cover includes at least one arm guide structure for guiding motion of the arm, and wherein the arm is operably coupled to the cover at the at least one guide structure.

5. The operator of claim 1, wherein the cam is selectively positionable between the first position and a second position relative to the base by at least one tie bar coupled to the cam.

6. A projection window and operator system comprising:

a window including a window frame and a window sash movably attached to the window frame; and an operator operably coupling the window frame the window sash, the operator comprising:

a base fixedly coupled to the window frame, the base defining a channel therein;

a window sash interface portion fixedly coupled to the window sash;

a cam engaged in with the channel of the base, the cam selectively slidably positionable in the channel between a first position and a second position relative to the base, wherein the cam includes a body portion with a generally s-shaped cam slot defined in the body portion; and an arm operably coupling the cam to the window sash interface portion, wherein the arm includes a cam follower portion, and wherein the cam follower portion is slidably disposed in the s-shaped cam slot of the cam, the window sash interface portion being positioned by the arm in a first retracted position proximate the channel when the cam is positioned in the first position and the window sash interface portion being positioned by the arm in a second extended position spaced-apart from the channel when the cam is positioned in the second position, so that movement of the cam from the first position to the second position projects the window sash outward from the window frame.

7. A method of operating a window having a window frame and a window sash movably attached to the window frame comprising the steps of:

a) providing an operator comprising:

a base defining a channel therein;

a window sash interface portion;

a cam engaged with the channel of the base, the cam selectively slidably positionable in the channel between a first position and a second position relative to the base, the cam including a body portion with a generally s-shaped cam slot defined in the body portion; and an arm operably coupling the cam to the window sash interface portion, the arm including a cam follower portion, wherein the cam follower portion is slidably disposed in the s-shaped cam slot of the cam, the window sash interface portion being positioned by the arm in a first retracted position proximate the channel when the cam is positioned in the first position and the window sash interface portion being positioned by the arm in a second extended position spaced-apart from the channel when the cam is positioned in the second position;

b) attaching the base to the window frame;

c) attaching the window sash interface portion to the window sash; and d) sliding the cam from the first position to the second position to project the window sash outward from the window frame, thereby opening the window.

8. The method of claim 7, further comprising the step of sliding the cam from the second position to the first position to retract the window sash into the window frame to close the window.

* * * * *